US007677920B2

(12) United States Patent
Huang et al.

(10) Patent No.: US 7,677,920 B2
(45) Date of Patent: Mar. 16, 2010

(54) ADAPTER CAPABLE OF STORING AND POSITIONING CABLES, AND ADAPTER HAVING A CABLE ORGANIZING DEVICE

(75) Inventors: Wen-Hung Huang, Taipei County (TW); Guan-De Liou, Taipei (TW); Stephen Tsai, Taipei County (TW); Shau-Yu Huang, Taipei (TW)

(73) Assignee: Hannspree, Inc, Taipei (TW)

( * ) Notice: Subject to any disclaimer, the term of this patent is extended or adjusted under 35 U.S.C. 154(b) by 0 days.

(21) Appl. No.: 12/318,985

(22) Filed: Jan. 14, 2009

(65) Prior Publication Data

US 2010/0015848 A1 Jan. 21, 2010

(30) Foreign Application Priority Data

Jul. 18, 2008 (TW) ..... 97127520 A

(51) Int. Cl.
*H01R 13/72* (2006.01)

(52) U.S. Cl. ..... 439/501

(58) Field of Classification Search ..... 439/501, 439/502; 191/12.2 R
See application file for complete search history.

(56) References Cited

U.S. PATENT DOCUMENTS

| | | | | |
|---|---|---|---|---|
| 6,402,546 | B1 * | 6/2002 | Groves et al. | 439/501 |
| 6,406,327 | B1 * | 6/2002 | Soon | 439/501 |
| 7,011,538 | B2 * | 3/2006 | Chang | 439/172 |
| 7,163,409 | B1 * | 1/2007 | Chen et al. | 439/131 |
| 7,168,538 | B2 * | 1/2007 | Pena | 191/12.2 R |
| 7,175,474 | B1 * | 2/2007 | Chang et al. | 439/501 |
| 7,189,106 | B2 * | 3/2007 | Young | 439/501 |
| 7,252,193 | B1 * | 8/2007 | Lewis et al. | 206/373 |
| 7,252,541 | B2 * | 8/2007 | Tsubaki et al. | 439/501 |
| 7,341,463 | B2 * | 3/2008 | Lai | 439/131 |
| D569,711 | S * | 5/2008 | Young, IV | D8/358 |
| 7,399,199 | B2 * | 7/2008 | Symons | 439/501 |
| 7,557,559 | B1 * | 7/2009 | Olsson et al. | 324/67 |
| 2003/0207611 | A1 * | 11/2003 | Lin et al. | 439/501 |
| 2003/0211774 | A1 * | 11/2003 | Tsai | 439/501 |
| 2005/0101181 | A1 * | 5/2005 | Bohn | 439/501 |
| 2006/0160385 | A1 * | 7/2006 | Tsukamoto et al. | 439/157 |
| 2006/0160412 | A1 * | 7/2006 | Symons | 439/501 |
| 2006/0264094 | A1 * | 11/2006 | Young | 439/501 |
| 2006/0292923 | A1 * | 12/2006 | Tsukamoto | 439/501 |
| 2007/0020993 | A1 * | 1/2007 | Symons | 439/501 |
| 2009/0035986 | A1 * | 2/2009 | Tracy et al. | 439/501 |

* cited by examiner

*Primary Examiner*—T C Patel
*Assistant Examiner*—Vladimir Imas
(74) *Attorney, Agent, or Firm*—Bacon & Thomas PLLC

(57) ABSTRACT

An adapter capable of storing and positioning cables comprises a main body, a cable, and a casing. The cable is connected to the main body, and the main body is wrapped by the casing. The casing comprises a cable organizing portion comprising a plurality of elastic loop grooves, and a guiding groove. By the above-mentioned structure, the guiding groove can guide the cable to the cable organizing portion. The plurality of elastic loop grooves is applied for organizing the cable.

4 Claims, 4 Drawing Sheets

ADAPTER CAPABLE OF STORING AND POSITIONING CABLES, AND ADAPTER HAVING A CABLE ORGANIZING DEVICE

BACKGROUND OF THE INVENTION

1. Field of the Invention

The present invention relates to an adapter and a cable organizing device, and, more particularly, to an adapter and a cable organizing device utilizing grooves to store cables.

2. Description of the Related Art

Many electronic devices require adapters to convert voltages and currents. The adapter usually has cables several feet in length. One end of the cable is plugged into a power socket, and the other end is connected to the electronic device.

However, in order to allow greater distance between the adapter and the power socket to which it is connected, the cable is usually quite long, and the extra length of cable might cause inconvenience. In prior art technology, some wrapping strips are provided for collecting the extra length of cable, but that solution is not ideal.

Therefore, it is desirable to provide an adapter capable of storing and positioning cables, and having a cable organizing device to mitigate and/or obviate the aforementioned problems.

SUMMARY OF THE INVENTION

A main objective of the present invention is to provide an adapter capable of storing and positioning cables.

Another objective of the present invention is to provide an adapter with an extendable casing for managing the cable.

Another objective of the present invention is to provide a cable organizing device for covering an adapter.

In order to achieve the above mentioned objectives, the adapter storing cords comprises a main body, a cable, and a casing. The cable is connected to the main body, and the main body is wrapped by the casing. The casing comprises a cable managing portion comprising a plurality of elastic loop grooves and a guiding groove. By the above-mentioned structure, the guiding groove can guide the cable to the cable managing portion. The plurality of elastic loop grooves is applied for storing the cable.

According to one embodiment of the present invention, the plurality of elastic loop grooves are spiral-like, are made of rubber, silicon or plastic materials, and have an arc cross-section shape.

In order to achieve another objective, the adapter capable of storing and positioning cables comprises an extendable adapter module having a extended state and a closed state; a cable connected to the extendable adapter module; and an extendable casing covering the extendable adapter module, the extendable casing comprising a plurality of ring-shaped grooves; when the extendable adapter module is in the extended state, the extendable casing is also extended.

In order to achieve another objective, the cable organizing device comprises a casing and a containing space. The casing has a plurality of elastic loop grooves. The containing space is located in the casing and used for containing the adapter. When the adapter is placed in the containing space, the plurality of elastic loop grooves stores the cable, and the plurality of elastic loop grooves position the cable.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
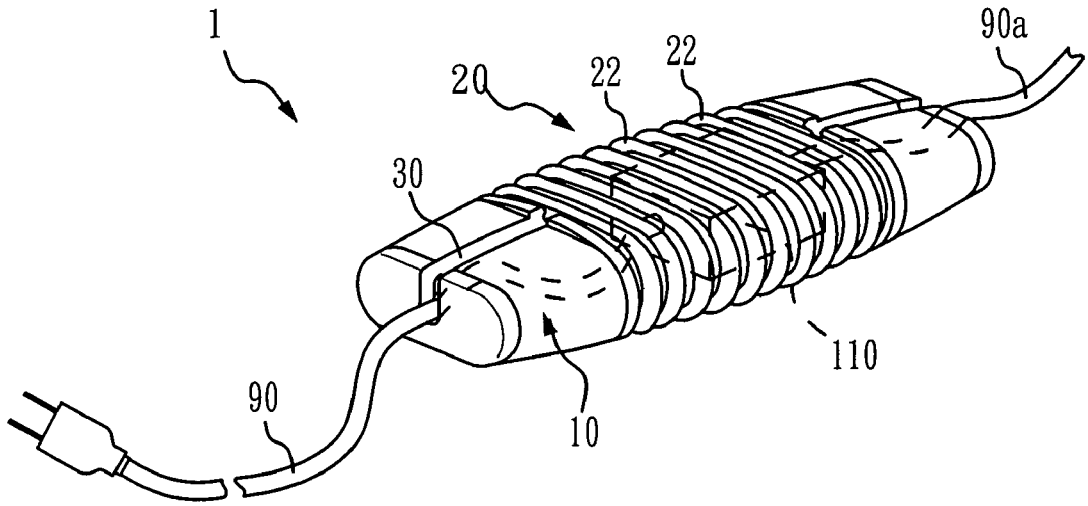
FIG. 1 is a perspective view of an adapter capable of storing and positioning cables in a first embodiment of the present invention.
Figure 2:
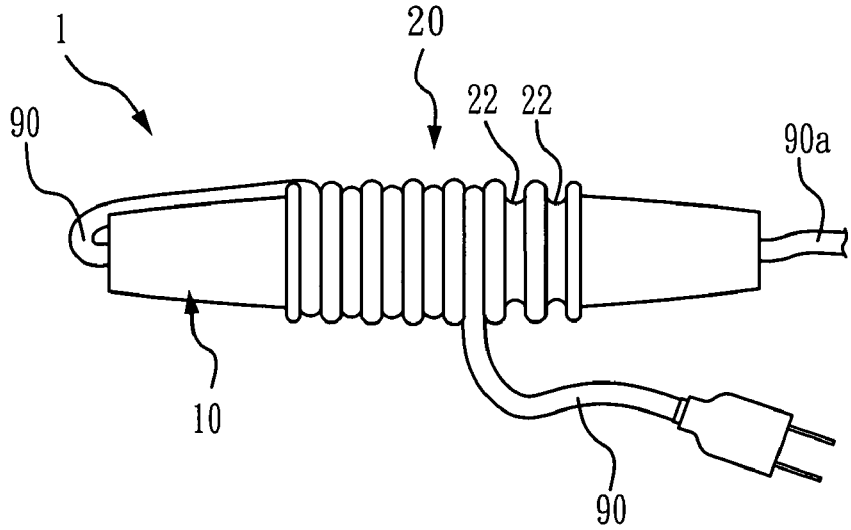
FIG. 2 is a side view of the adapter capable of storing and positioning cables in a first embodiment of the present invention.

Please refer to FIG. 1 and FIG. 2. FIG. 1 is a perspective view of an adapter capable of storing and positioning cables in a first embodiment of the present invention. FIG. 2 is a side view of the adapter capable of storing and positioning cables in a first embodiment of the present invention.

An adapter 1 capable of storing and positioning cables comprises a main body 110, cables 90, 90*a*, and a casing 10. The main body 110 is disposed in the adapter 1 and comprises electronic elements for adjusting voltages and currents. The adapter 1 capable of storing and positioning cables can be any body shape, such as an elliptic, circular, or rectangular shape.

The cables 90, 90*a* are separately connected to two opposite ends of the main body 110.

The casing 10 covers the main body 110, and the casing 10 and the main body 110 are formed together as a whole. The casing 10 comprises a cable organizing portion 20 and a guiding groove 30. The cable organizing portion 20 has a plurality of elastic loop grooves 22, and the cables 90, 90*a* are coiled into the plurality of elastic loop grooves 22 (as shown in FIG. 2). Furthermore, a user can coil a portion of the cable 90 into one side of the cable organizing portion 20, or coil a portion of the cable 90*a* to be stored into another side of the cable organizing portion 20; or the user can separately coil both the cable 90 and the cable 90*a* into both sides of the cable organizing portion 20.

In this embodiment, the plurality of elastic loop grooves 22 is spiral-like in shape such that the cables 90, 90*a* can be continuously coiled therein. However, the plurality of elastic loop grooves 22 can also be parallel loops, such as several ring-shaped grooves arranged in parallel with each other.

Figure 3A:
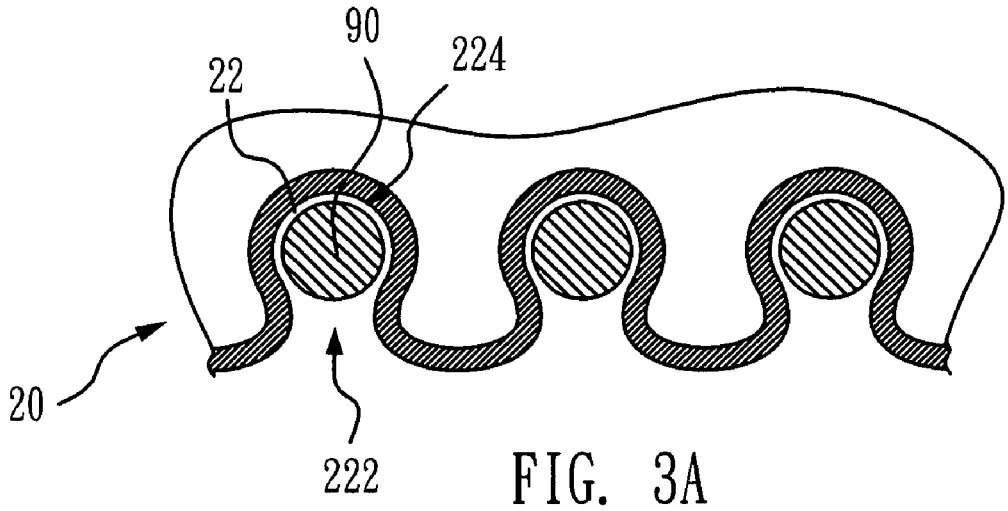
FIG. 3A is a cross-sectional view of the adapter storing the cable according to the present invention.

Please refer to FIG. 3A. FIG. 3A is a cross-sectional view of the adapter storing the cable according to the present invention. In this embodiment, the elastic loop grooves 22 are made of rubber, silicon, or plastic materials and have an arc cross-section shape. The elastic loop grooves 22 forms an entering region 222 and a containing region 224. Since the width of the entering region 222 is slightly smaller than the diameter of the cable 90, the user needs to push the cable 90 through the entering region 222, and then the cable 90 moves from the entering region 222 into the containing region 224. Furthermore, when the cable 90 is placed in the containing region 224, the elastic loop grooves 22 can provide clapping strength to secure the cord 90 in the cable organizing portion 20.

Figure 3B:
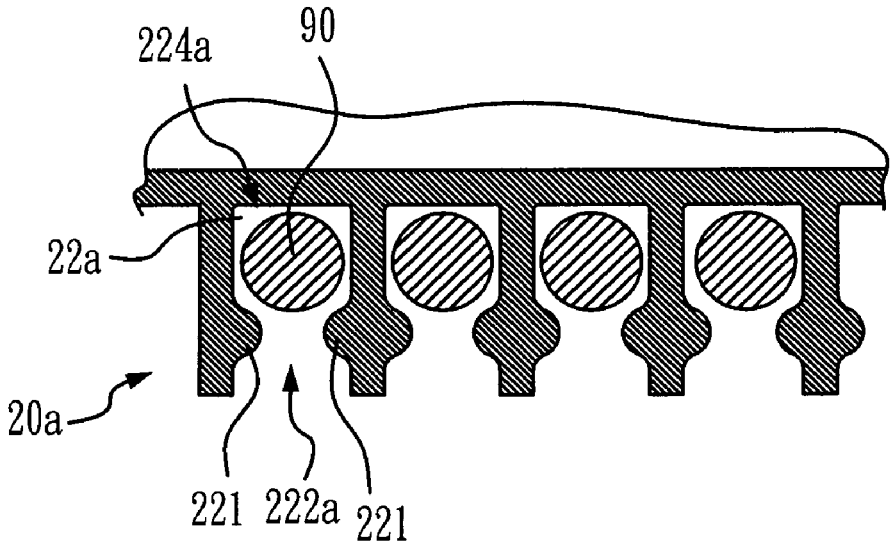
FIG. 3B is a cross-sectional view of the adapter storing the cable according to another embodiment of the present invention.

Please refer to FIG. 3B. FIG. 3B is a cross-sectional view of the adapter storing the cable according to another embodiment of the present invention. In this embodiment, the elastic loop grooves 22*a* are made of plastic and have a U cross-sectional shape. Each elastic loop groove 22*a* forms an entering region 222*a* and a containing region 224*a*, and the inside of each elastic loop groove 22*a* has a stopping element 221. The stopping element 221 is used for stopping the cable 90 from exiting from the containing region 224*a*. In this embodiment, each elastic loop groove 22*a* has two protruding portions used as the stopping element 221, disposed close to the entering region 222.

In this embodiment, the elastic loop grooves 22*a* are made of plastic, rubber, or silicon materials and the protruding portions close to the entering region 222*a* have bendable elasticity. When the cable 90 enters from the entering region 222*a*, the stopping elements 221 block the entrance, and the user needs to apply force to bend the stopping elements 221 so that the cable 90 can be smoothly placed into the containing region 224*a*.

Please refer back to FIG. 1. Since the cables 90, 90*a* are at the two opposite ends of the adapter 1, in order to guide the cables 90, 90*a* into the cable organizing portion 20, the casing 10 further comprises a guiding groove 30. In this embodiment, the guiding groove 30 is connected to the cable organizing portion 20, and the cable guiding directions of the guiding groove 30 and the elastic loop grooves 22 are substantially perpendicular to each other. However, the cable guiding directions of the guiding groove 30 and the elastic loop grooves 22 can also form an inclined angle. Therefore, the cables 90, 90*a* at the two ends of the adapter 1 can first enter the guiding groove 30 and then enter into the cable organizing portion 20 such that no portions of the lengths of cables 90, 90*a* protrude from the casing 10.

Moreover, the guiding groove 30 can also be spiral-like in shape, and the width of the guiding groove 30 is larger than the width of the cable organizing portion 20 such that the cables 90, 90*a* can smoothly enter into the cable organizing portion 20 via the guiding groove 30.

Figure 4:
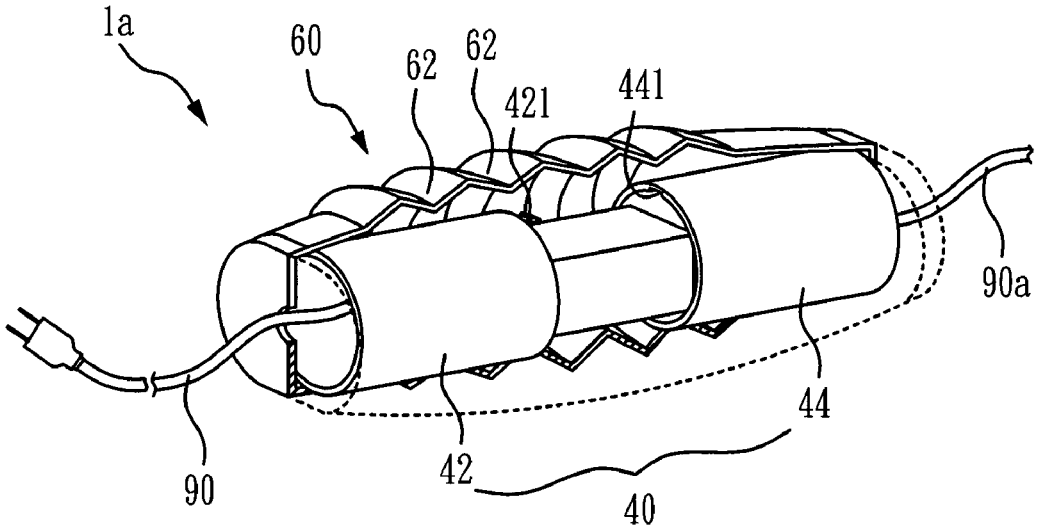
FIG. 4 is a schematic drawing of the adapter capable of storing and positioning cables in a second embodiment of the present invention.
Figure 4A:
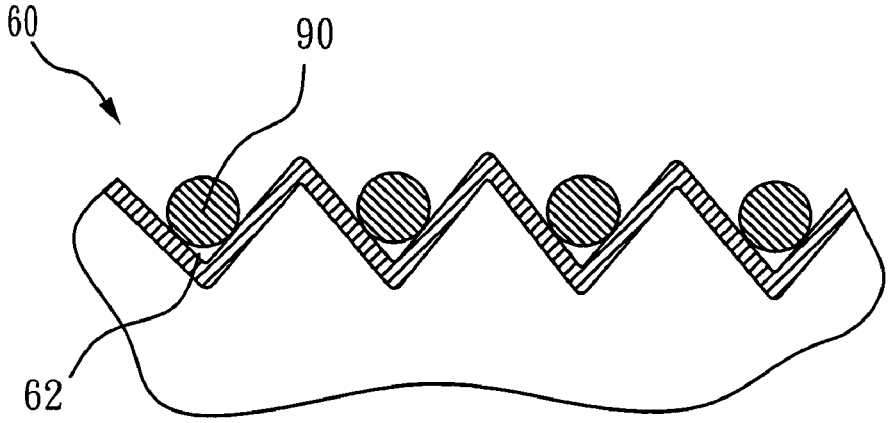
FIG. 4A is a cross-sectional view of the second embodiment shown in FIG. 4.

Please refer to FIG. 4 and FIG. 4A. FIG. 4 is a schematic drawing of the adapter capable of storing and positioning cables in a second embodiment of the present invention. FIG. 4A is a cross-sectional view of the second embodiment shown in FIG. 4. In a second embodiment, an adapter 1*a* capable of storing and positioning cables with an extendable structure.

The adapter 1*a* comprises an extendable module 40, cables 90, 90*a* and an extendable casing 60. The cables 90, 90*a* are separately connected to two ends of the extendable module 40. The extendable module 40 comprises all typical electronic elements for the adapter, and the extendable module 40 further comprises a first sliding element 42 and a second sliding element 44. The first sliding element 42 is able to slide relative to the second sliding element 44 such that the extendable module 40 has an extended state and a closed state. Furthermore, the first sliding element 42 and the second sliding element 44 can comprise a set of sliding components, such as sleeves, sliding rods, or sliding tracks.

The extendable casing 60 covers the outside of the extendable module 40, and the extendable casing 60 comprises a plurality of ring-shaped grooves 62. In this embodiment, the ring-shaped grooves 62 are in a continuous spiral, and the ring-shaped grooves 62 are made of plastic and have a V cross-sectional shape. The ring-shaped grooves 62 have flexible characteristics and can be folded repeatedly to form a V-shaped groove.

When the adapter 1*a* is in the extended state (as shown in FIG. 4 and FIG. 4A), the extendable module 40 and the extendable casing 60 are both extended. In this extended state, the width of the plurality of ring-shaped grooves 62 is larger, so the user can easily coil the cables 90, 90*a* into them. However, the plurality of ring-shaped grooves 62 does not clip the cables 90, 90*a*.

When the adapter 1*a* is in the closed state, the extendable module 40 and the extendable casing 60 are both compressed, so the plurality of ring-shaped grooves 62 have smaller gaps between them. Since the plurality of ring-shaped grooves 62 has flexible characteristics, a portion of each ring-shaped groove 62 is compressed to hold the cable 90.

Furthermore, in order to lock the extendable module 40 of the adapter 1*a* when the adapter 1*a* is closed, the first sliding element 42 has a first securing element 421, the second sliding element 44 has a second securing element 441, and the first securing element 421 can be attached to the second securing element 441. For example, the first securing element 421 and the second securing element 441 can be a matching secure structure such as a hook and a slot. When the first securing element 421 is attached to the second securing element 441, the plurality of ring-shaped grooves 62 provide clapping force to the cable 90, and the cable 90 can securely hold in the plurality of ring-shaped grooves 62.

Moreover, the shape and material of the ring-shaped grooves 62 can vary from the above-mentioned description. For example, the ring-shaped grooves 62 can also be parallel loops, the ring-shaped grooves 62 can be made of rubber or silicon materials, and the cross-sectional shape of the ring-shaped grooves 62 can also be an arc.

Figure 5:
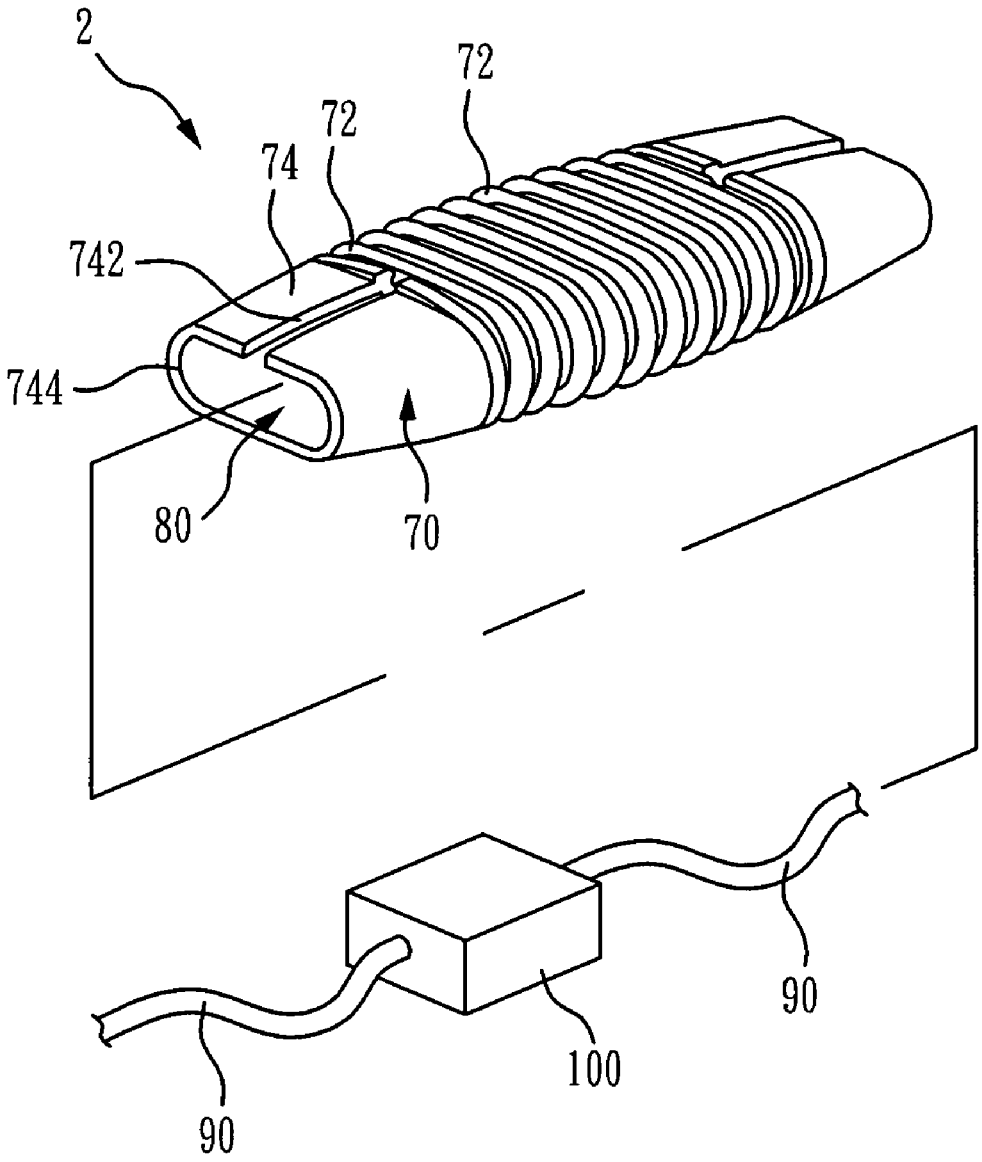
FIG. 5 is a perspective view of a cable organizing device according to the present invention.

Please refer to FIG. 5. FIG. 5 is a perspective view of a cable organizing device according to the present invention. The cable organizing device 2 can be used to store the cables of a typical adapter 100. The cable organizing device 2 comprises a casing 70 and a containing space 80. The casing 70 is a thin cover body that can tightly cover the adapter 100.

The casing 70 comprises a plurality of elastic loop grooves 72. In this embodiment, the elastic loop grooves 72 are spiral-like, made of rubber or silicon materials, and have an arc cross-sectional shape. However, the elastic loop grooves 72 can also be parallel loops.

The containing space 80 is inside the casing 70, and the containing space 80 is capable of containing the adapter 100. The cross-sectional area of the containing space 80 is substantially equal to or smaller than the cross-sectional area of the adapter 100. When the containing space 80 is filled with the adapter 100, the plurality of elastic loop grooves 72 are used for placing the cable 90, and the plurality of elastic loop grooves 72 can secure the cable 90.

In this embodiment, the cable organizing device 2 further comprises a shrinking area 74. The shrinking area 74 is connected to the elastic loop grooves 72, and the shrinking area 74 is located at the end of the cable organizing device 2. Since the shrinking area 74 has a narrow opening 744, the cable organizing device 2 can provide a more secure cover for the adapter 100.

Furthermore, the shrinking area 74 comprises a guiding groove 742, and the guiding groove 742 guides the cable 90 into the plurality of elastic loop grooves 72. The directions of the guiding groove 742 and the plurality of elastic loop grooves 72 are substantially perpendicular to each other. Moreover, the guiding groove 742 can also be inclined, spiral, or arc shapes.

Since when the cable organizing device 2 covers the adapter 100, it can provide the same benefits as the adapter 1 capable of storing and positioning cables, there will be no further description.

Although the present invention has been explained in relation to its preferred embodiment, it is to be understood that many other possible modifications and variations can be made without departing from the spirit and scope of the invention as hereinafter claimed.

What is claimed is:

1. An adapter capable of storing and positioning cables comprising:

an extendable module having an extended state and a closed state;

a cable is connected to the extendable module; and an extendable casing covering the extendable module, the extendable casing comprising a plurality of ring-shaped grooves; when the extendable module is in the extended state, the extendable casing is also extended, wherein the extendable module comprises a first sliding element and a second sliding element; the first sliding element is capable of sliding relative to the second sliding element, the first sliding element has a first securing element, the second sliding element has a second securing element, and by attaching the first securing element to the second securing element the extendable adapter module is locked in the closed state.

2. The adapter capable of storing and positioning cables as claimed in claim 1, wherein the plurality of ring-shaped grooves are spiral-like or parallel loop shapes.

3. The adapter capable of storing and positioning cables as claimed in claim 2, wherein the plurality of ring-shaped grooves are made of rubber, silicon, or plastic materials.

4. The adapter capable of storing and positioning cables as claimed in claim 3, wherein a cross-section of the plurality of elastic loop grooves is an arc shape or a V shape.

* * * * *